US006973683B2

(12) United States Patent
Lev et al.

(10) Patent No.: US 6,973,683 B2
(45) Date of Patent: Dec. 13, 2005

(54) BATH APPARATUS

(75) Inventors: Mordechai Lev, West Bloomfield, MI (US); Roman S. Ferber, West Bloomfield, MI (US); Stephen Chung, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 58 days.

(21) Appl. No.: 10/687,007

(22) Filed: Oct. 16, 2003

(65) Prior Publication Data

US 2005/0081292 A1 Apr. 21, 2005

(51) Int. Cl.[7] ..... A47K 3/022; A61H 35/00; E03C 1/00

(52) U.S. Cl. ..... 4/622; 4/541.2; 4/621; D24/213; 601/158; 601/166

(58) Field of Search ..... 4/541.1–541.3, 4/621, 622; D24/213; 601/19, 22, 154, 157, 601/158, 160, 166, 167

(56) References Cited

U.S. PATENT DOCUMENTS

| | | | | |
|---|---|---|---|---|
| 3,741,201 | A | 6/1973 | Oudkerk | |
| 3,837,334 | A * | 9/1974 | Johnson | 601/19 |
| 4,398,789 | A | 8/1983 | Pryor | |
| 4,807,602 | A * | 2/1989 | Scarborough et al. | 601/160 |
| 5,245,221 | A | 9/1993 | Schmidt et al. | |
| 6,309,366 | B1 | 10/2001 | Maxwell | |
| D453,836 | S | 2/2002 | Gillette et al. | |
| D455,498 | S | 4/2002 | Gillette et al. | |
| 6,405,390 | B2 | 6/2002 | Kuen | |
| 6,438,768 | B1 | 8/2002 | Yen | |
| 6,505,358 | B2 * | 1/2003 | Ferber et al. | 4/622 |
| D473,317 | S | 4/2003 | Lie | |
| 6,568,000 | B1 * | 5/2003 | Kaufman et al. | 4/622 |
| 6,598,244 | B1 | 7/2003 | Yeh | |
| 6,602,212 | B1 | 8/2003 | Ahn | |
| 2003/0070222 | A1 | 4/2003 | Bastia et al. | |
| 2003/0120184 | A1 | 6/2003 | Cafaro | |
| 2003/0126679 | A1 | 7/2003 | Leung et al. | |
| 2003/0220593 | A1 | 11/2003 | Morton | |
| 2003/0226201 | A1 | 12/2003 | Leung et al. | |

OTHER PUBLICATIONS

Dr. Scholl's Advertisement for Model DR6628 Foot Spa in Home World Business, Jul.-Aug. 2003.
Dr. Scholl's Advertisement for Model DR6686 Foot Spa in Supplement to Home World Business, Spring 2003.

* cited by examiner

*Primary Examiner*—Tuan Nguyen
(74) *Attorney, Agent, or Firm*—Brooks Kushman P.C.

(57) ABSTRACT

A bath apparatus for bathing a body part, such as feet, includes a bath chamber for containing fluid and receiving the user's feet therein. The bath apparatus includes a heater for heating the bath chamber fluid, and a fluid pump for directing streams of water into the bath chamber to massage the user's feet. A float switch is provided so that the heater and the fluid pump only operate if there is an adequate amount of fluid in the bath chamber. The bath apparatus also includes a selection device disposed within the bath chamber, that is configured to be actuated by the user's feet when they are submerged within the bath chamber fluid. This provides a higher water pressure only after the feet are disposed within the bath chamber, thereby reducing the likelihood that water will be expelled from the bath chamber.

25 Claims, 8 Drawing Sheets

10
168
168
26
24
48
26
25
48
88
30
170
22
22
30
28
30
22
170
30
22
29
84
116
64
76
78
80
68
120
62
58
86
60
124
16
70
72
74
50
140
130
82
136
138
134
132
146
146
118
144
142
56
146
52
44
54
96
46
32
98
44

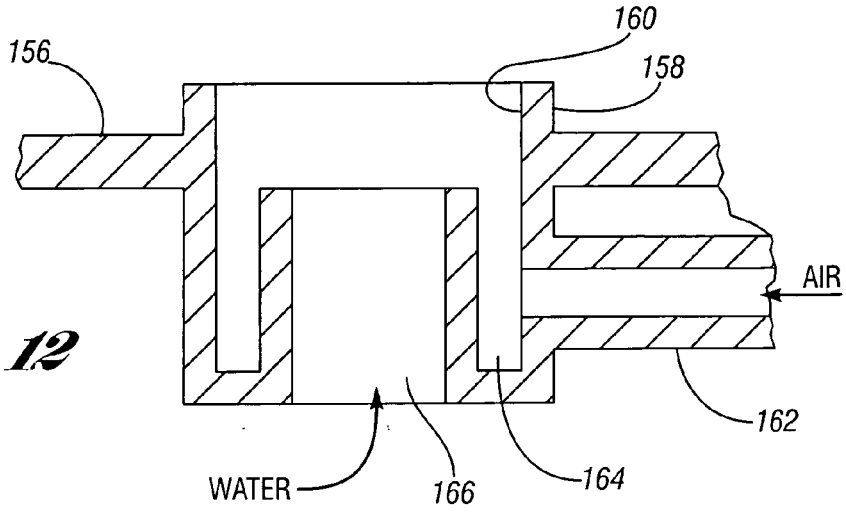
Fig. 12
Fig. 13A
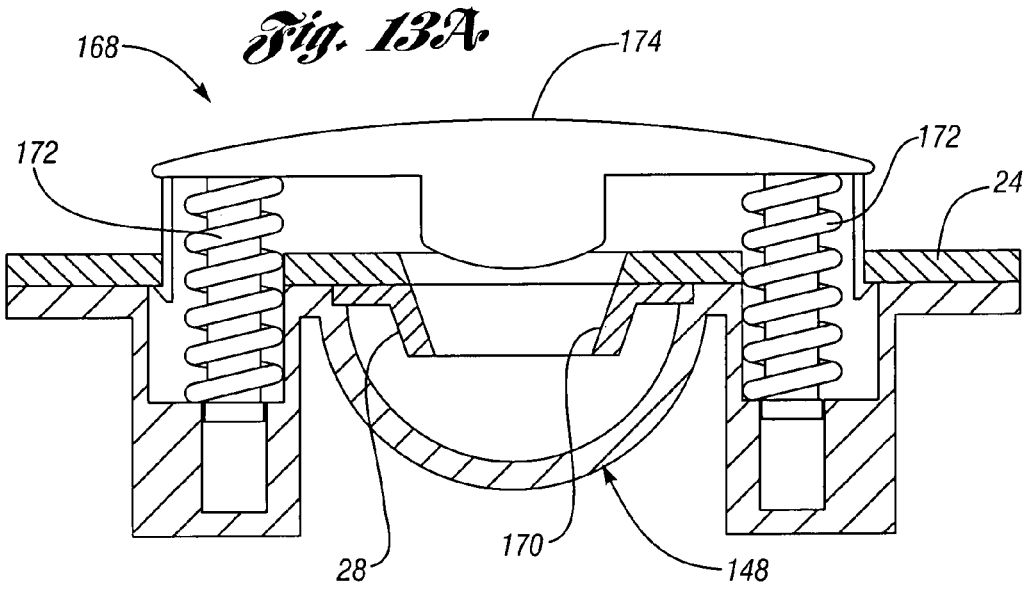
Fig. 13B
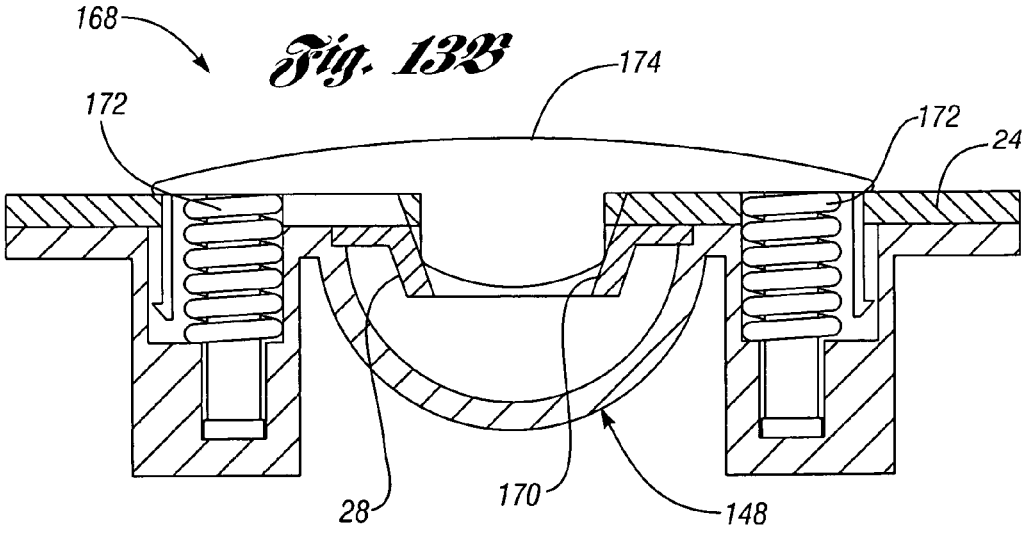

BATH APPARATUS

BACKGROUND OF THE INVENTION

1. Field of the Invention

This invention relates to an apparatus for bathing body parts, such as the feet or hands.

2. Background Art

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of foot baths have been utilized as therapeutic devices for the feet. Typically, foot baths provide heated water for which the temperature is maintained via electrical means. In addition, current foot baths often provide massage to the feet through vibration of the foot bath. Vibratory massage enhances the therapeutic results achieved with soaking alone by further increasing circulation, as well as relaxing and massaging the muscles.

In addition to vibratory massage, a foot bath may employ the use of water jets to provide concentrated massage to different areas of the feet. For example, to massage the bottom of the feet, jets can be strategically placed in the bottom surface of the foot bath to direct water upward. One shortcoming of such a design is the potential to spray water out of the foot bath if the user's feet are not in the bath to deflect the water streams. Moreover, even if the jets are not pointed directly upward, water can still be expelled if the pressure is too high and the user's feet are not in the bath. One solution is to limit the water pressure to a level that is not great enough to expel water from the bath. This solution may be of limited practical use, however, in that a higher water pressure may be desired by the user to provide an adequate massage.

Therefore, a need exists for a bath apparatus having water jets to provide streams of water to massage a body part, and yet also provides a mechanism for automatically increasing the pressure of the water flowing through the jets after the body part to be massaged is at least partially submerged, thereby limiting the water jet pressure until the body part is in a position to deflect the water streams and keep the water within the bath apparatus.

SUMMARY OF THE INVENTION

Accordingly, the invention provides an apparatus for bathing a body part. The apparatus includes a bath chamber for containing fluid and receiving the body part therein. The bath chamber includes at least one surface having a plurality of apertures for providing fluid flow therethrough. The apparatus also includes a fluid pump in communication with the bath chamber for directing fluid into the bath chamber through at least some of the apertures to contact the body part. A selection device is at least partially disposed within the bath chamber, and is configured to be selectively actuated by the body part when the body part is at least partially within the bath chamber. The selection device includes at least a first setting and a second setting. The first setting facilitates fluid flow through the at least some apertures at a first pressure, and the second setting facilitates fluid flow through the at least some apertures at a second pressure higher than the first pressure.

The invention also provides an apparatus for bathing a body part which includes a bath chamber for containing fluid and receiving the body part therein. The bath chamber includes at least one surface having a plurality of apertures for providing fluid flow therethrough. The apparatus also includes a fluid pump in communication with the bath chamber for directing fluid into the bath chamber to contact the body part. A valve is in communication with ambient air outside the bath chamber and with at least some of the apertures. The valve has a first setting for inhibiting introduction of air into the bath chamber through the at least some apertures. The valve also has at least one other setting for effecting introduction of air into the bath chamber through the at least some apertures to generate air bubbles in the fluid contained within the bath chamber. A selection device is at least partially disposed within the bath chamber and configured to be selectively actuated by the body part when the body part is at least partially within the bath chamber. The selection device includes at least a first setting and a second setting. The first setting facilitates fluid flow through the at least some apertures at a first pressure. The second setting facilitates fluid flow through the at least some apertures at a second pressure higher than the first pressure.

The invention further provides an apparatus for bathing a body part which includes a bath chamber for containing fluid and receiving the body part therein. The bath chamber includes at least one surface having a plurality of apertures for providing fluid flow therethrough. The apparatus also includes a fluid pump in communication with the bath chamber for directing fluid into the bath chamber through at least some of the apertures to contact the body part. A selection device is in communication with the fluid pump, and it includes at least a first setting and a second setting. The first setting facilitates fluid flow through the at least some apertures at a first pressure, and the second setting facilitates fluid flow through the at least some apertures at a second pressure higher than the first pressure. The selection device is configured to delay for a predetermined amount of time the increase to the second pressure after the second setting is selected. This provides time for the body part to be at least partially submerged in the bath chamber fluid before the increase to the second pressure.

BRIEF DESCRIPTION OF THE DRAWINGS

FIG. 12 is a fragmentary side sectional view of an alternative arrangement of a nozzle and tube;

FIGS. 13A and 13B are partial sectional views of a selection device used to selectively increase the pressure of the fluid flowing into the bath chamber;

DETAILED DESCRIPTION OF THE PREFERRED EMBODIMENT(S)

Figure 1:
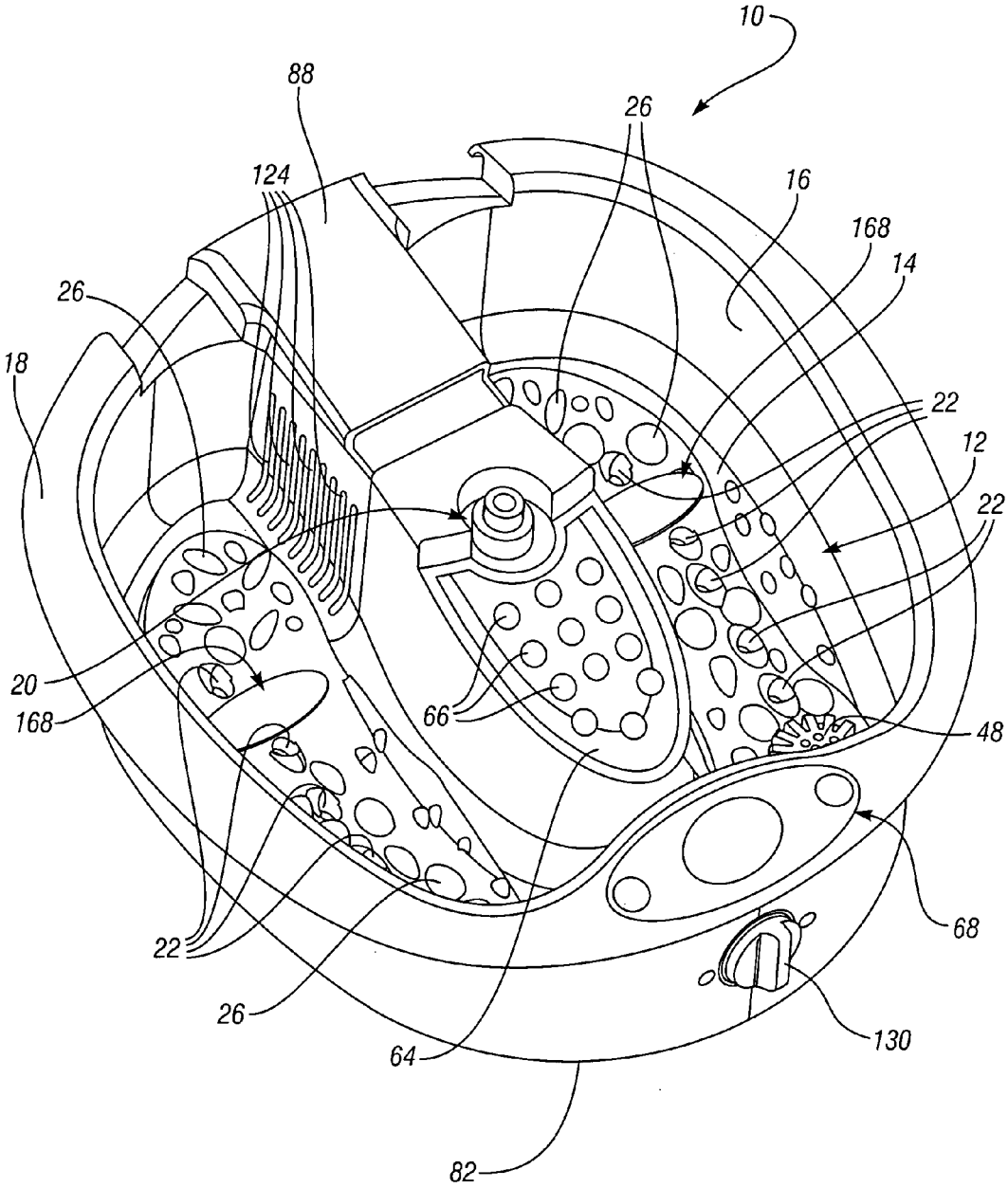
FIG. 1 is a perspective view of a bath apparatus in accordance with the present invention, having a lid removed to show the bath chamber.

FIG. 1 shows a bath apparatus 10 in accordance with the present invention. The bath apparatus 10 can be used to provide heat, water jets, bubbles, and combinations thereof to body parts, such as feet. The bath apparatus 10 is preferably constructed from a plastic material so as to be lightweight and portable, as well as durable, leakproof, and corrosion resistant. Although the bath apparatus 10 is illustrated and described herein as being particularly adaptable for use as a footbath, it is understood that the bath apparatus 10 of the present invention may be used for bathing other body parts, such as the hands.

The bath apparatus 10 includes a bath chamber 12 for containing fluid, such as water, and receiving the body part, such as the foot, therein. The bath chamber 12 includes a bottom surface 14 and a wall structure 16 extending upwardly therefrom. The wall structure 16 terminates in an upper surface 18 that includes a contact portion 20 adapted to be exposed when water is contained in the bath chamber 12. The bottom surface 14 can be generally parallel to a supporting surface on which the bath apparatus 10 is placed, or alternatively, the bottom surface 14 could be slanted downward toward the user.

The bath chamber 12 is of a length and width to accommodate the feet of an adult user, such that sufficient space is provided for the user's feet to be readily inserted and removed, and to allow the feet to be moved about slightly while in position within the bath chamber 12. In a preferred embodiment, the bath chamber 12 is generally U-shaped and the contact portion 20 is generally peninsular and centrally disposed within the bath chamber 12. With this configuration, a user's feet are received on either side of the peninsular contact portion 20, wherein the feet are spaced apart sufficiently to provide comfortable placement. For use, the bath chamber 12 is filled with water to a level such that a user's feet may be submerged up to approximately the height of the ankles. As described more fully below, the bottom surface 14 includes a number of apertures 22 which act as water jets when the water from the bath chamber 12 is pumped through them. In addition, one of the user's feet can be easily removed from the bath chamber 12 and placed on the contact portion 20 for targeted therapy as described below. Of course, it is understood that the contact portion 20 can have any location on the bath apparatus 10 which remains uncovered by water and is accessible to the user.

Figure 2:
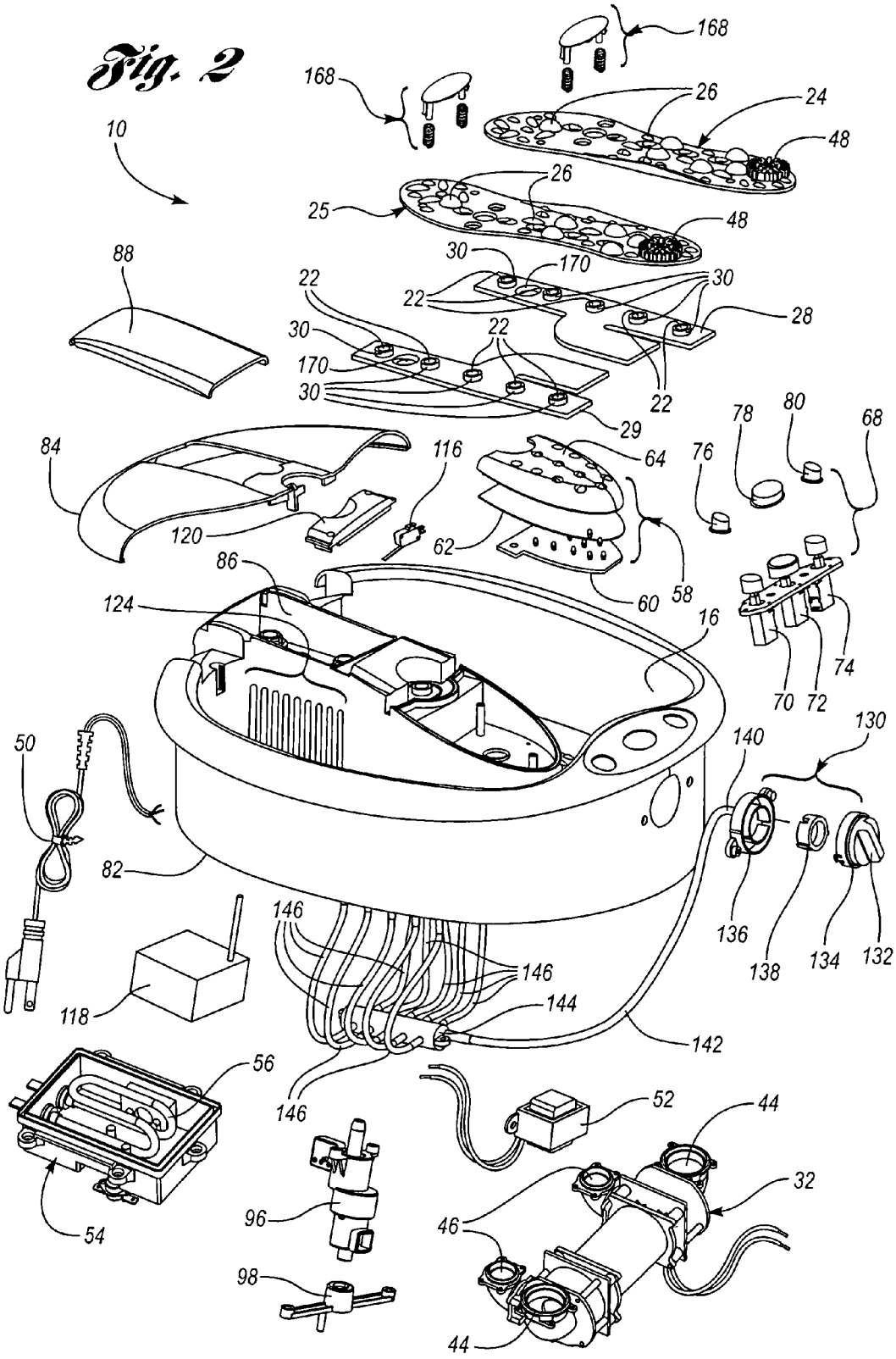
FIG. 2 is an exploded view of the bath apparatus shown in FIG. 1.
Figure 3A:
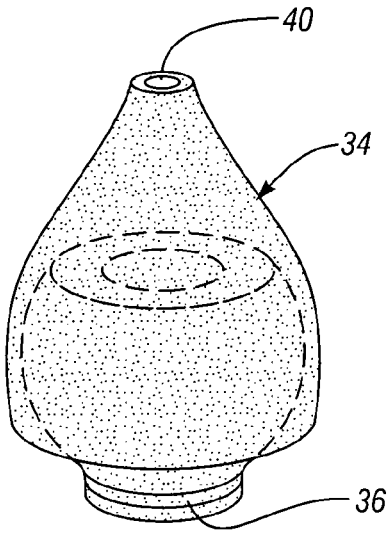
FIGS. 3A and 3B show a perspective view and a sectional view, respectively, of an adjustable nozzle for directing fluid into the bath chamber.
Figure 3B:
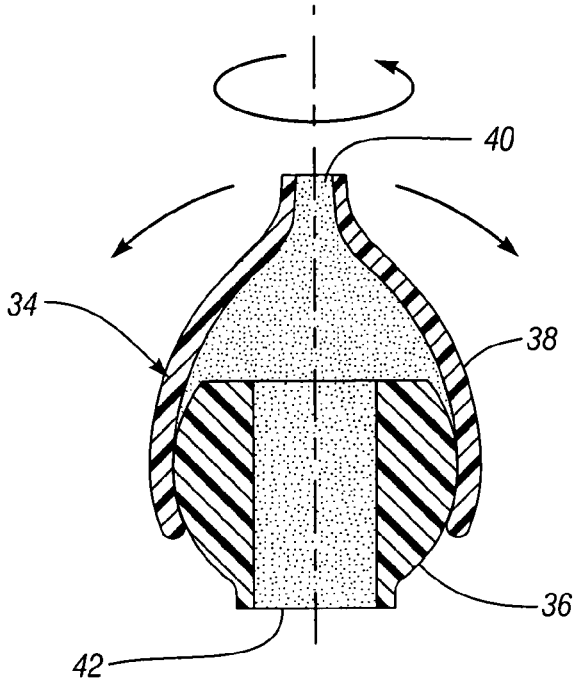

With additional reference to FIG. 2, the components of the bath apparatus 10 are now explained in more detail. For example, the bottom surface 14 includes right and left foot pads 24, 25. The foot pads 24, 25 each include a plurality of nodes 26 which can be of varying sizes. The nodes 26 function to massage the feet upon contact, and also allow water to flow under them. The apertures 22 are formed in right and left plates 28, 29, each of which includes nozzles 30. The right and left plates 28, 29 form a portion of the bottom surface 14. The nozzles 30 help to direct water as it pumped through the apertures 22 by a fluid pump 32. As an alternative to the fixed nozzles 30, adjustable nozzles, such as adjustable nozzles 34 shown in FIGS. 3A and 3B, may be used. Each of the nozzles 34 includes a two-piece construction, wherein a first portion 36 can be attached to, or integrally molded with, a plate, such as the plates 28, 29. As shown in FIG. 3B, a second portion 38, which can be snap-fit onto the first portion 36, cooperates with the first portion 36 to make the nozzles 34 adjustable. The second portion 38 is configured to rotate around the first portion 36 so that a user can independently aim, in almost any direction, each water jet coming through the nozzles 34. In addition, the nozzles 34 include outlets 40 that have a smaller cross-sectional diameter than inlets 42, resulting in an increase in the velocity of the fluid leaving the nozzles.

Returning now to FIGS. 1 and 2, it is shown that the fluid pump 32 includes a pair of inlets 44 and a pair of outlets 46. The inlets 44 are configured to draw fluid through intake ports 48 in the foot pads 24, 25. The fluid pump 32 receives power through an electrical cord 50, which is configured to plug into a standard electrical outlet. Because the bath apparatus 10 may include devices and electrical circuits that require a voltage other than that provided by a standard electrical outlet, a transformer 52 is provided. In order to heat water in the bath chamber, the bath apparatus 10 includes a heater 54. The heater 54 utilizes a resistive heating element 56, though the use of other types of heaters is contemplated.

In addition to providing the heater 54 for heating the water, the bath apparatus 10 also includes an infrared heater 58. The infrared heater 58 includes an infrared circuit board 60, which is protected from the bath chamber water by a seal 62. A cover 64 is configured to contact the user's body part, and includes nodes 66, which, like the nodes 26, function to massage the body part on contact. To activate the fluid pump 32 and the heaters 54, 58, or some combination thereof, a switch assembly 68 is provided. The switch assembly 68 includes first, second, and third switches 70, 72, 74, which are configured to respectively activate the infrared heater 58, the fluid pump 32 and the water heater 54. Seals 76, 78, 80 are provided to protect the switches 70, 72, 74 from the bath chamber fluid.

The bath apparatus 10 includes a housing 82, which encases the bath chamber 12, and may be constructed of multiple pieces. A lid 84 is configured for snap-fit attachment to the wall structure 16 to at least partially cover the bath chamber 12. A lid, such as the lid 84, can also be configured for other types of attachment, for example, a hinged attachment. It is worth noting here that the embodiment of the bath apparatus shown in FIGS. 1 and 2, includes apertures only in the bottom surface 14 of the bath chamber 12. In other embodiments, apertures which communicate with a fluid pump can be included in a wall structure to provide water jets originating from the sides of the bath chamber. Moreover, a lid, such as the lid 84, may be integrally formed with a wall structure and also configured with apertures which communicate with the fluid pump. Thus, water jets can be configured to provide a stream of water to a user's feet, or other body part, from the bottom, sides, or top of the bath apparatus. The lid 84 partially covers a storage area 86, which may conveniently house one or more massage attachments. A panel 88 includes a hinged attachment to the housing 82, and thus can be used to provide access to the storage area 86 without removing the lid 84.

The contact portion 20 is configured to receive massage attachments 90, 92, 94 (shown in FIGS. 4–8), each of which may be stored in the storage area 86. As shown in FIG. 2, a motor 96 is disposed on an underside of the bath chamber 12, and may be attached to the housing 82 with a motor bracket 98, using screws (not shown). The massage attachments 90, 92, 94 are adapted to be received on an output shaft 100—see FIG. 8A—that is rotatably driven by the motor 96 and adapted to be accessible through the contact portion 20. With reference to FIGS. 5 and 8A, massage attachments 90, 92, 94 each include a recess 102 configured to securely receive the output shaft 100 as it projects through the contact portion 20. More particularly, the recess 102 includes a plurality of tabs 104 sized to be received in corresponding slots 106 provided on the output shaft 100. The motorized rotation of massage attachments 90, 92, 94 is activated by pressure of a body part applied thereon, which then establishes electrical contact to supply power to the motor 96. Alternatively, the motor 96 can be configured to operate when the user actuates a manual switch (not shown).

Figure 4:
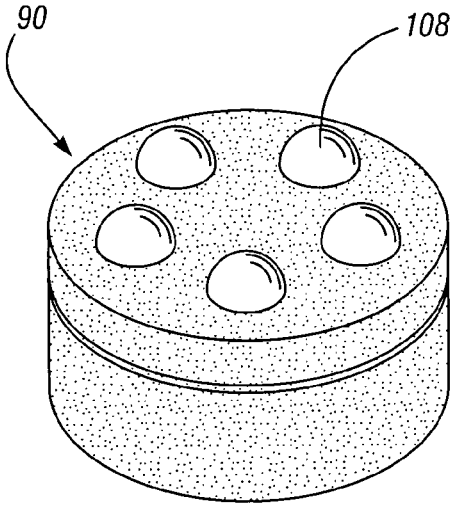
FIG. 4 is a perspective view of a first rotatable massage attachment adapted to be received on a contact portion of the bath apparatus.
Figure 5:
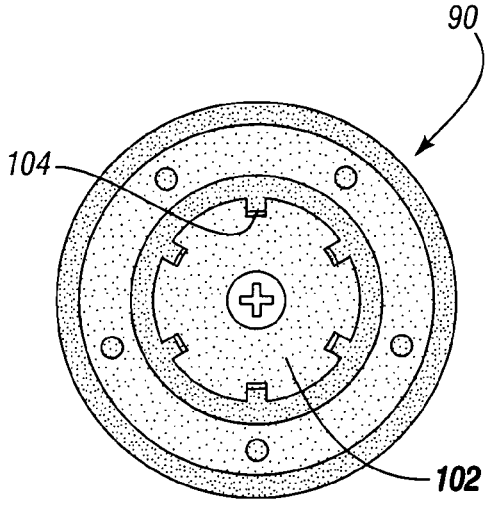
FIG. 5 is a bottom plan view of the first rotatable massage attachment.
Figure 6:
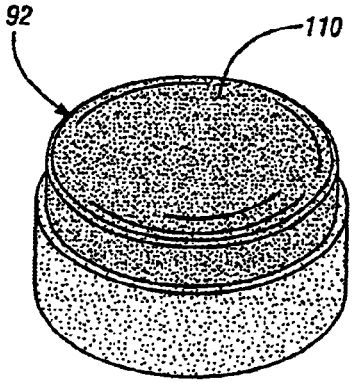
FIG. 6 is a perspective view of a second rotatable massage attachment which includes a pumice stone.
Figure 7:
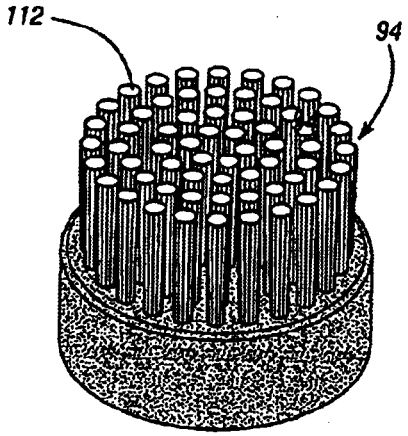
FIG. 7 is a perspective view of a third rotatable massage attachment which includes a brush.
Figure 8A:
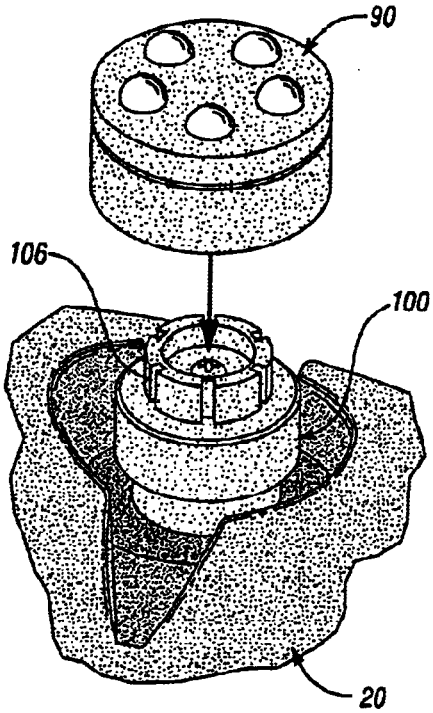
FIGS. 8A and 8B are fragmentary perspective views of the first rotatable massage attachment before and after attachment to the contact portion, respectively.
Figure 8B:
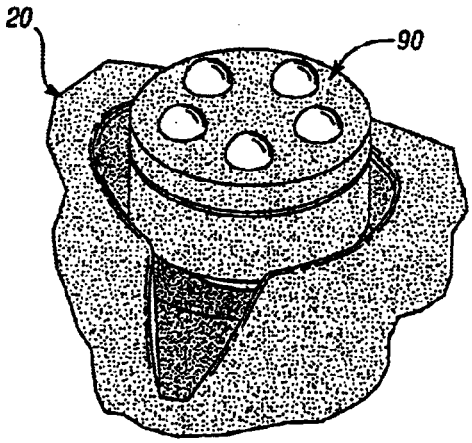

Three different massage attachments for use with the bath apparatus 10 are illustrated in FIGS. 4–7. A first rotatable massage attachment 90, as shown in FIG. 4, includes raised nodes 108 which provide pressure points to gently massage a user's foot when contacted. FIG. 6 depicts a second rotatable massage attachment 92 that includes a pumice stone 110 to smooth and soften skin on the soles of the feet. FIG. 7 depicts a third rotatable massage attachment 94, that includes a brush 112 to clean and exfoliate skin. The particular massage attachments 90, 92, 94 shown and described herein are merely exemplary, and any other suitable massage attachment can be used in accordance with the present invention.

Figure 9A:
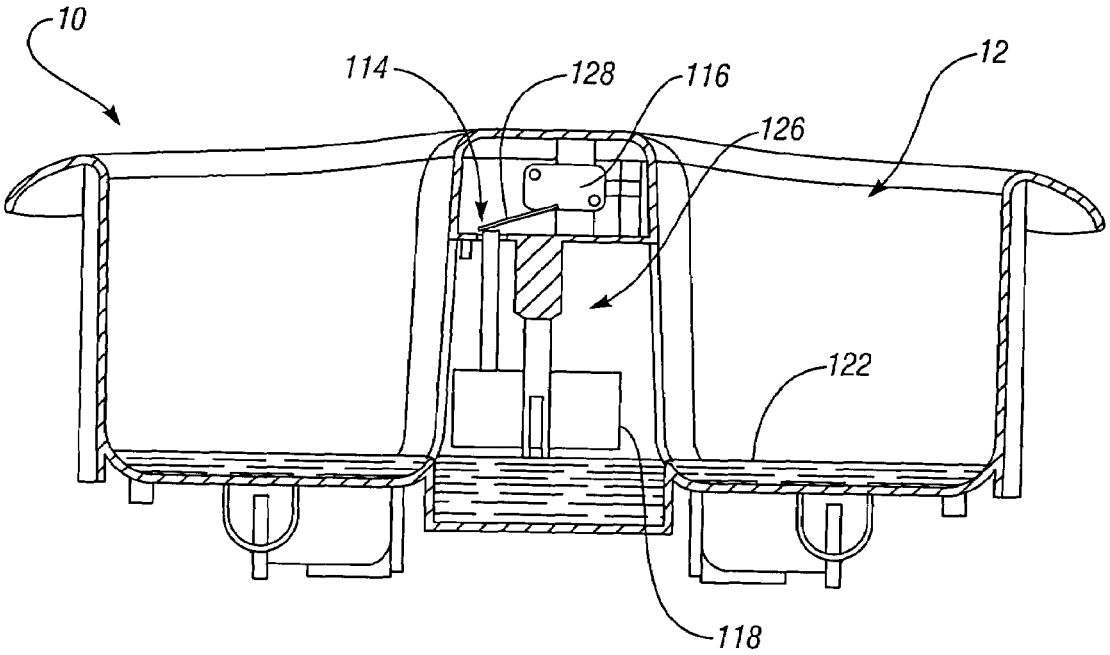
FIGS. 9A and 9B are partial sectional views of the bath apparatus including a float switch in a first and second position, respectively.
Figure 9B:
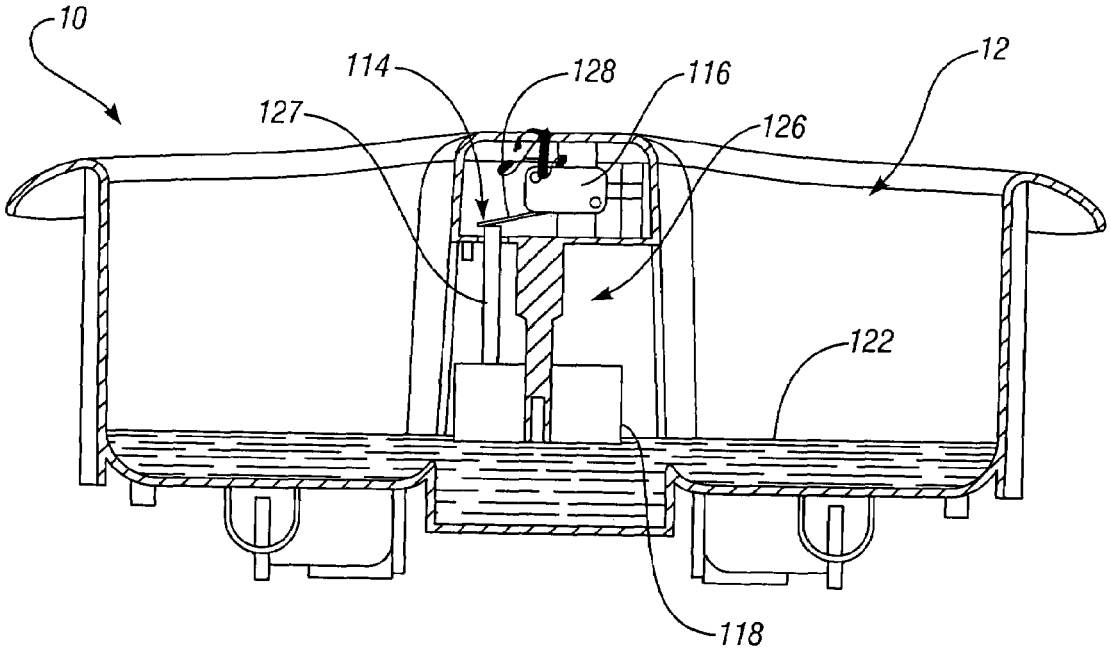

The bath apparatus 10 also includes a float switch 114, the operation of which is shown in FIGS. 9A and 9B. As best seen in FIG. 2, the float switch 114 includes a switch portion 116 and a float portion 118. A switch cover 120 protects the switch portion 116 from the bath chamber fluid. The switch portion 116 is in electrical communication with the fluid pump 32, the wiring for which has been removed from FIG. 2 for clarity. As shown in FIGS. 9A and 9B, the float portion 118 is configured to float in the bath chamber fluid 122, thereby rising when the fluid level in the bath chamber 12 rises. As seen in FIGS. 1 and 2, the bath chamber includes a plurality of slots 124, which allow the fluid 122 to enter a float chamber 126—see FIGS. 9A and 9B. In FIG. 9A, the float portion 118 of the float switch 114 is at its lowest level. In fact, the level of the fluid 122 is not great enough to even contact the float portion 118. The switch portion 116 is shown in FIG. 9A in a first position, which prohibits operation of the fluid pump 32. In this way, the use of the float switch 114 helps to ensure that the fluid pump 32 will not operate unless an adequate amount of fluid 122 is in the bath chamber 12.

In FIG. 9B, the fluid 122 is at a higher level, which has caused the float portion 118 of the float switch 114 to rise upward. When there is enough fluid 122 in the bath chamber 12, the float portion 118 rises to a certain level that is high enough to actuate the switch portion 116. In particular, an arm 127 attached to the float portion 118 contacts a switch lever 128 on the switch portion 116. This places the switch portion 116 in a second position which facilitates operation of the fluid pump 32. In addition to prohibiting operation of the fluid pump 32 when the fluid level in the bath chamber 12 is too low, the float switch 114 can be similarly configured to prohibit operation of the heater 54. Because the heater 54 is configured to heat the fluid in the bath chamber 12, having it connected to the float switch 114 helps to ensure that it will not unnecessarily operate when there is little or no fluid in the bath chamber 12. Of course, if desired, the float switch 114 can be configured to prohibit operation of all of the bath chamber 10 electrical devices, including the motor 96 and the infrared heater 58.

As shown in FIGS. 1 and 2, the bath apparatus 10 also includes a valve 130. The valve 130 is in communication with ambient air outside the bath chamber 12, and with the apertures 22. As shown in FIG. 2, the valve 130 includes a selector knob 132 which a user can rotate from a first setting, which inhibits introduction of air into the bath chamber 12 through the apertures 22, to a second setting, which effects introduction of air into the bath chamber 12 through the apertures 22 to generate air bubbles in the bath chamber fluid. The selector knob 132 is disposed within a first housing portion 134, which cooperates with a second housing portion 136 to house a valve ring 138. When the first valve setting is selected, the valve ring 138 operates to block air flow through an outlet 140 in the second housing portion 136. Conversely, when the second valve setting is selected, the valve ring 138 facilitates the flow of ambient air through the outlet 140 and into a conduit, or hose, 142.

Figure 10:
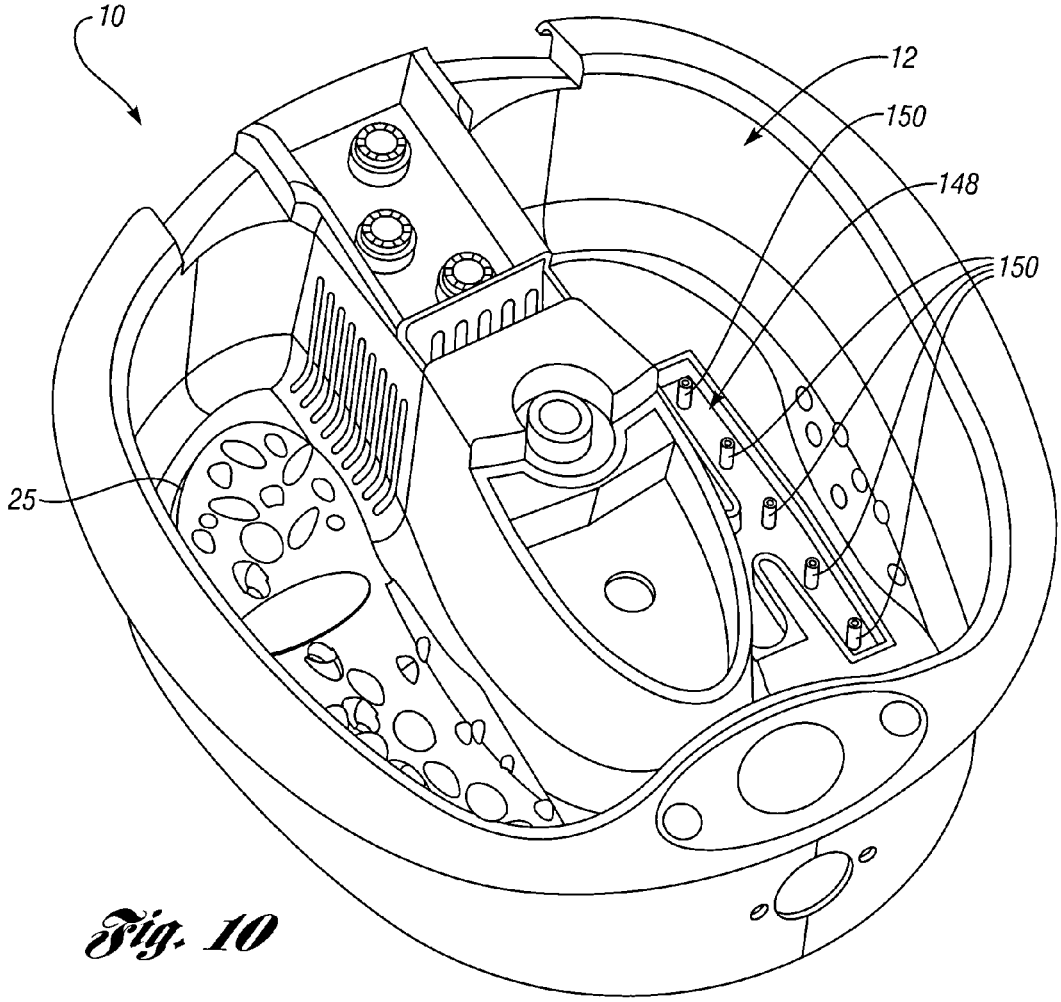
FIG. 10 is a perspective view of a portion of the bath apparatus, illustrating a fluid channel beneath a right foot pad.

The hose 142 is connected to a manifold 144 which has connected to it a plurality of conduits, or hoses, 146. Each of the hoses 146 is in communication with a respective aperture 22. FIG. 10 shows the bath apparatus 10 with the right foot pad 24 removed. In the following description, the right side of the bath apparatus 10 is used for illustrative purposes. The bath apparatus 10 has a generally mirror image symmetry from the right side to the left side, so the description of the right side of the bath apparatus 10 is generally applicable to the left side. FIG. 10 shows a fluid channel 148 below the right foot pad 24. Disposed through the fluid channel 148 is a plurality of short tubes 150 which are integrally molded into the bath apparatus housing 82. Each of the hoses 146 connects to a lower portion of a respective tube 150 (not visible) below the bath apparatus 10. When the plate 28 is installed in the bath apparatus 10, it covers the channel 148, and each of the apertures 22 are disposed above a respective tube 150—see FIG. 11. Alternatively, a single hose, such as the hose 146, could be used to supply the entire channel 148.

Figure 11:
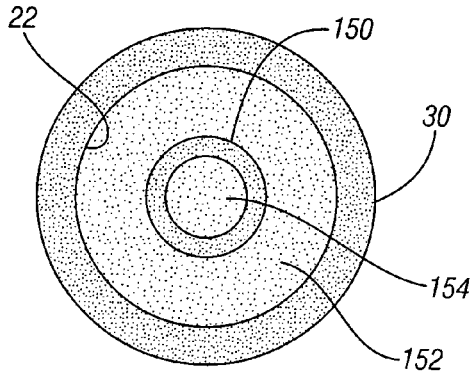
FIG. 11 is a top plan view of a nozzle and a tube through which water and air are respectively directed into the bath chamber.

FIG. 11 shows a top, plan view of a nozzle 30 and a tube 150 when the plate 28 covers the channel 148. In this configuration, the aperture 22 has an annular portion 152, which surrounds a center portion 154. In operation, the fluid pump 32 receives bath chamber fluid through the inlets 44 and pumps it out through the outlets 46. Upon leaving the outlets 46, some of the bath chamber fluid is pumped into the channel 148, and some is pumped into a channel on the left side of the bath apparatus 10, which is hidden from view in FIG. 11 by the left foot pad 25. As fluid continues to be pumped through the fluid pump 32, it leaves the channel 148 and enters the bath chamber 12 through the annular portions 152 of the apertures 22. If the second setting of the valve 130 has been selected, the movement of the fluid through the annular portions 152 draws air into the bath chamber 12 through the hoses 146 and through the center portions 154 of the apertures 22. The manifold 144 and/or the hose 142 may include a check valve to keep the bath chamber fluid from traveling back through the hose 142 and leaking out of the valve 130.

FIG. 12 shows a side sectional view of a plate 156 similar to the plates 28, 29, shown in FIG. 2. Integrally formed with the plate 156 is a nozzle 158 having an aperture 160. A tube 162 is in communication with the aperture 160 and is configured for attachment to a hose, such as the hoses 146. The aperture 160 includes an annular portion 164 and a center portion 166. Using a nozzle and tube arrangement, such as shown in FIG. 12, a fluid pump, such as the fluid pump 32, can pump bath chamber fluid through the center portion 166, drawing air from the tube 162 through the annular portion 164 and into the bath chamber. In both of the configurations shown in FIGS. 11 and 12, the pressure of the air introduced into the bath chamber is proportional to the pressure of the fluid being directed into the bath chamber by the fluid pump. Thus, the amount of air bubbles introduced into the bath chamber fluid can be controlled by controlling the pressure of the fluid pump.

In order to control the pressure output of the fluid pump 32, the bath apparatus 10 includes selection devices 168—see FIG. 1 and FIGS. 13A and 13B. The selection devices 168 are disposed within the bath chamber 12, and are configured to be selectively actuated by a body part, such as feet, when the feet are at least partially within the bath chamber 12. As described in detail below, with reference to FIGS. 13A and 13B, the selection device 168 includes first and second settings, where the first setting facilitates fluid flow through the apertures 22 at a first pressure, and the second setting facilitates fluid flow through the apertures 22 at a second pressure, which is higher than the first pressure. As discussed above, the fluid pump 32 pumps fluid taken from the bath chamber 12 through the intake ports 48 back into the bath chamber 12 via the channel 148 on the right side of the bath apparatus 10. A similarly configured channel on the left side of the bath apparatus 10 serves the same function. Using the right side of the bath apparatus 10, and the channel 148, for illustrative purposes, the apertures 22 that are disposed in the right plate 28 may generally be called a set of apertures, since each is configured to receive fluid pumped through the channel 148.

As shown in FIG. 2, the plate 28 not only contains the apertures 22, but also contains a larger aperture, which may be called a control aperture 170. Similarly, the left plate 29 also contains a control aperture 170. Turning to FIG. 13A, a sectional view of the first setting of the selection device 168 is shown. At the first setting, two springs 172 are biased against a plug 174, keeping it away from the control aperture 170. At this setting, bath chamber fluid is pumped out of the fluid pump 32, into the channel 148, out through the apertures 22 in the right plate 28, and also through the control aperture 170. Because the control aperture 170 is larger than the apertures 22, much of the fluid flowing out of the channel 148 and into the bath chamber 12 flows through the control aperture 170.

The force of the fluid flowing through the control aperture 170 is diminished prior to contacting the user's feet, or other body part, because of the presence of the plug 174. In addition, the pressure of the fluid flowing through the smaller apertures 22 is reduced because of the fluid flowing through the control aperture 170. This arrangement allows a user to initiate operation of the fluid pump 32 without concern that water will be sprayed out of the bath chamber 12. Upon submerging a foot, or other body part, the user can selectively close the control aperture 170 by pushing downward on the plug 174 against the biasing of the springs 172. As shown in FIG. 2, the plug 174 is movable downward to close the control aperture 170, which forces the fluid to flow through the smaller apertures 22, thereby effecting an increase in the pressure of the fluid flowing through the apertures 22.

Figure 14:
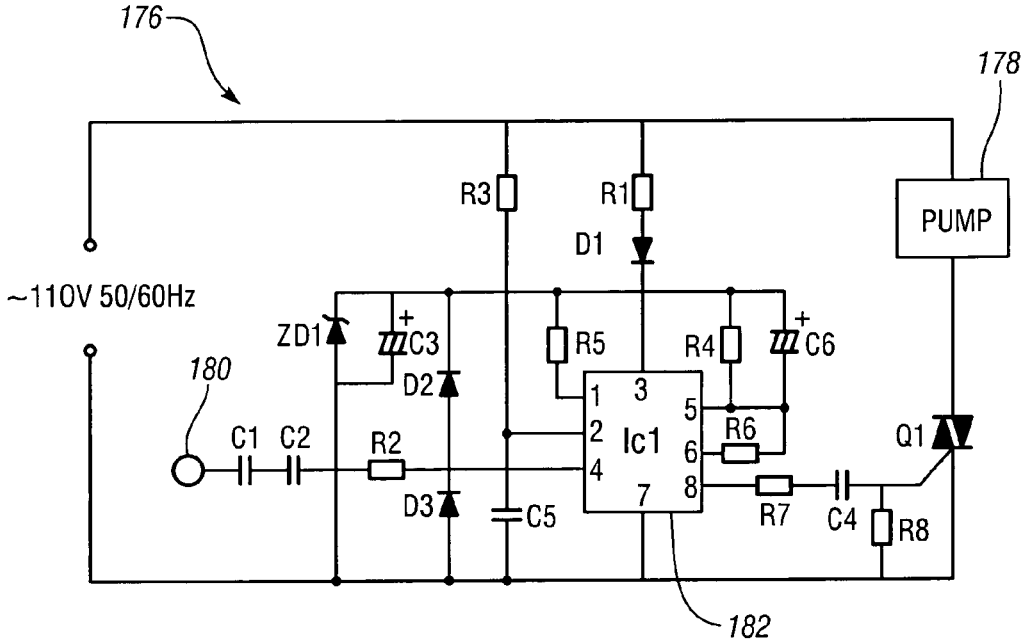
FIG. 14 is a schematic diagram of a control circuit used to control operation of a fluid pump on the bath apparatus.

The selection device 168 illustrated in FIGS. 13A and 13B uses mechanical principles to increase the pressure of the fluid after the user's feet, or other body part, is submerged. Of course, a similar result can be achieved using electronic control of a fluid pump, such as the fluid pump 32. For example, FIG. 14 shows an electrical circuit 176 that can be used to control the operation of a fluid pump 178. This type of control circuit has broad applications, and is known to those skilled in the art. Specifically, a touch pad 180 can be disposed within a bath chamber, such as the bath chamber 12, in a location to be easily contacted by a body part submerged therein.

The circuit 176 includes a programmable controller 182 that can be programmed with a number of control algorithms. For example, the control circuit 176 can be configured such that the pump 178 is operated to output fluid at different pressures depending on how many times the touch pad 180 is contacted. Initially, for example, the fluid pump may be prohibited from operating until the user contacts the touch pad 180 a first time. One or more subsequent contacts with the touch pad 180 can increase the output pressure of the fluid pump 178 until a desired pressure is reached. Once a maximum pump pressure is reached, a subsequent contact with the touch pad 180 may turn the fluid pump 178 completely off.

Alternatively, the control circuit 176 can be configured such that contact with the touch pad 180 merely turns the fluid pump on and off. In particular, the controller 182 can be configured to vary the fluid pump pressure according to a preprogrammed algorithm. In this way, the water pressure can be varied from low to high, or from high to low, in various combinations. In addition, a controller, such as the controller 182, may be used with an appropriately configured fluid pump to separately control the water jet pressure on the left and right sides of a bath chamber.

In another variation, the programmable controller 182 can be preprogrammed with a delay feature, and connected to a switch accessible from outside of the bath chamber, such as the switch 72 shown in FIG. 2. In such a configuration, a user could actuate the switch prior to placing a body part within the bath chamber, knowing that the fluid pump would not operate, or at least would not operate a high pressure, for some predetermined amount of time after the switch was actuated. This provides the user adequate time to submerge the body part into the bath chamber to help ensure that fluid was not expelled from the bath chamber.

Figure 15:
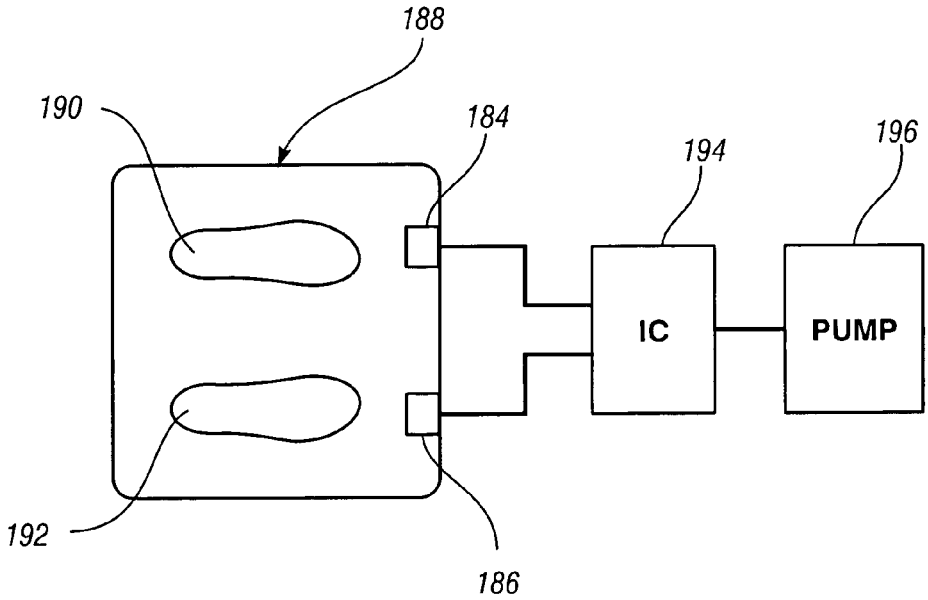
FIG. 15 is a simplified schematic diagram of a control circuit used to control operation of a fluid pump on a bath apparatus.

FIG. 15 shows a simplified schematic diagram of another embodiment of the present invention, wherein the selection devices include proximity sensors 184, 186. The proximity sensors 184, 186 are disposed in a bath chamber 188, near foot pads 190, 192, and are configured to detect the presence of close objects, such as a user's feet. A controller 194 communicates with the proximity sensors 184, 186, and also communicates with a fluid pump 196. Thus, when a user's feet enter the bath chamber 188 and come within a predetermined distance of the proximity sensors 184, 186, operation of the fluid pump 196 is facilitated.

The controller 194 can be programmed in any of a number of ways to control actuation of the fluid pump 196. For example, the controller 194 can be configured such that both proximity sensors 184, 186 need to detect an object before the fluid pump 196 is operated. Alternatively, the pump 196 can be configured to separately supply water to right and left portions of the bath chamber 188, so that each proximity sensor 184, 186 facilitates operation of only a portion of the fluid pump 196. Moreover, the controller 194 can be configured to start operation of the fluid pump 196 when it receives a signal from the proximity sensor, or if the fluid pump is already operating, the controller 194 can use the proximity sensor signal to command the fluid pump 196 to operate at a higher pressure.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for bathing a body part, the apparatus comprising:

a bath chamber for containing fluid and receiving the body part therein, the bath chamber including at least one surface having a plurality of apertures for providing fluid flow therethrough;

a fluid pump in communication with the bath chamber for directing fluid into the bath chamber through at least some of the apertures to contact the body part; and a selection device at least partially disposed within the bath chamber and configured to be selectively actuated by the body part when the body part is at least partially within the bath chamber, the selection device including at least a first setting and a second setting, the first setting facilitating fluid flow through the at least some apertures at a first pressure, and the second setting facilitating fluid flow through the at least some apertures at a second pressure higher than the first pressure.

2. The apparatus of claim 1, wherein the apertures include a set of apertures configured to receive fluid from the pump through a first channel, and wherein the selection device includes a control aperture in the at least one surface and a plug for selectively opening and closing the control aperture, the control aperture being configured to receive fluid from the pump through the first channel, thereby facilitating fluid flow through the set of apertures at one pressure when the control aperture is open and at a higher pressure when the control aperture is closed.

3. The apparatus of claim 1, further comprising a plurality of nozzles, each of the nozzles being disposed adjacent a respective aperture in the at least one surface, the nozzles being adjustable for directing fluid flow from the respective apertures.

4. The apparatus of claim 1, wherein the at least one surface includes a bottom surface.

5. The apparatus of claim 1, further comprising a controller in communication with the fluid pump and the selection device, the controller being configured to vary the fluid pump pressure according to a preprogrammed algorithm when the selection device is actuated.

6. The apparatus of claim 1, wherein selection device includes a proximity sensor configured to facilitate operation of the fluid pump when the body part comes within a predetermined distance of the proximity sensor.

7. The apparatus of claim 1, further comprising a float switch having a switch portion in electrical communication with the fluid pump, and a float portion configured to float in fluid contained in the bath chamber, thereby rising when the fluid level in the bath chamber rises, the switch portion having a first position for prohibiting operation of the fluid pump, and a second position for facilitating operation of the fluid pump, the float portion being further configured to cooperate with the switch portion to place the switch portion in the second position when the float portion rises to a certain level.

8. The apparatus of claim 7, further comprising a heater disposed in relation to the bath chamber for heating fluid contained in the bath chamber, the heater being in electrical communication with the float switch such that operation of the heater is prohibited when the switch portion is in the first position and operation of the heater is facilitated when the switch portion is in the second position.

9. The apparatus of claim 1, wherein the selection device includes a control circuit having at least one touch pad disposed within the bath chamber, the control circuit being configured to selectively facilitate operation of the fluid pump when the body part contacts the touch pad.

10. The apparatus of claim 9, wherein the control circuit is configured to prohibit operation of the fluid pump until the body part contacts the touch pad one time, and to facilitate operation of the fluid pump at predetermined pressures when the body part contacts the touch pad subsequent times, the control circuit being further configured to prohibit operation of the fluid pump when the body part contacts the touch pad after a maximum pump pressure has been reached.

11. An apparatus for bathing a body part, the apparatus comprising:

a bath chamber for containing fluid and receiving the body part therein, the bath chamber including at least one surface having a plurality of apertures for providing fluid flow therethrough;

a fluid pump in communication with the bath chamber for directing fluid into the bath chamber to contact the body part;

a valve in communication with ambient air outside the bath chamber and with at least some of the apertures, the valve having a first setting for inhibiting introduction of air into the bath chamber through the at least some apertures, and at least one other setting for effecting introduction of air into the bath chamber through the at least some apertures to generate air bubbles in the fluid contained within the bath chamber; and a selection device at least partially disposed within the bath chamber and configured to be selectively actuated by the body part when the body part is at least partially within the bath chamber, the selection device including at least a first setting and a second setting, the first setting facilitating fluid flow through the at least some apertures at a first pressure, and the second setting facilitating fluid flow through the at least some apertures at a second pressure higher than the first pressure.

12. The apparatus of claim 11, wherein the apertures include a set of apertures configured to receive fluid from the pump through a first channel, and wherein the selection device includes a control aperture in the at least one surface and a plug for selectively opening and closing the control aperture, the control aperture being configured to receive fluid from the pump through the first channel, thereby facilitating fluid flow through the set of apertures at one pressure when the control aperture is open and at a higher pressure when the control aperture is closed.

13. The apparatus of claim 11, further comprising a plurality of nozzles, each of the nozzles being disposed adjacent a respective aperture in the at least one surface, the nozzles being adjustable for directing fluid flow from the respective apertures.

14. The apparatus of claim 11, further comprising a controller in communication with the fluid pump and the selection device, the controller being configured to vary the fluid pump pressure according to a preprogrammed algorithm when the selection device is actuated.

15. The apparatus of claim 11, wherein selection device includes a proximity sensor configured to facilitate operation of the fluid pump when the body part comes within a predetermined distance of the proximity sensor.

16. The apparatus of claim 11, further comprising a float switch having a switch portion in electrical communication with the fluid pump, and a float portion configured to float in fluid contained in the bath chamber, thereby rising when the fluid level in the bath chamber rises, the switch portion having a first position for prohibiting operation of the fluid pump, and a second position for facilitating operation of the fluid pump, the float portion being further configured to cooperate with the switch portion to place the switch portion in the second position when the float portion rises to a certain level.

17. The apparatus of claim 16, further comprising a heater disposed in relation to the bath chamber for heating fluid contained in the bath chamber, the heater being in electrical communication with the float switch such that operation of the heater is prohibited when the switch portion is in the first position and operation of the heater is facilitated when the switch portion is in the second position.

18. The apparatus of claim 11, further comprising a plurality of conduits, each of the conduits being in fluid communication with the valve and with a respective aperture, and wherein the fluid pump is operable to direct fluid into the bath chamber through the at least some apertures, thereby drawing air through at least some of the conduits and into the bath chamber through respective apertures when the valve is set to effect introduction of air into the bath chamber.

19. The apparatus of claim 18, wherein the pressure of air introduced into the bath chamber through the respective apertures is proportional to the pressure of the fluid directed into the bath chamber by the fluid pump.

20. The apparatus of claim 18, wherein the at least some apertures include an annular portion surrounding a center portion, and wherein the fluid is directed by the fluid pump into the bath chamber through the annular portions, thereby drawing air through respective center portions.

21. The apparatus of claim 18, wherein the at least some apertures include an annular portion surrounding a center portion, and wherein the fluid is directed by the fluid pump into the bath chamber through the center portions, thereby drawing air through respective annular portions.

22. The apparatus of claim 11, wherein the selection device includes a control circuit having at least one touch pad disposed within the bath chamber, the control circuit being configured to selectively facilitate operation of the fluid pump when the body part contacts the touch pad.

23. The apparatus of claim 22, wherein the control circuit is configured to prohibit operation of the fluid pump until the body part contacts the touch pad one time, and to facilitate operation of the fluid pump at predetermined pressures when the body part contacts the touch pad subsequent times, the control circuit being further configured to prohibit operation of the fluid pump when the body part contacts the touch pad after a maximum pump pressure has been reached.

24. An apparatus for bathing a body part, the apparatus comprising:

a bath chamber for containing fluid and receiving the body part therein, the bath chamber including at least one surface having a plurality of apertures for providing fluid flow therethrough;

a fluid pump in communication with the bath chamber for directing fluid into the bath chamber through at least some of the apertures to contact the body part; and a selection device in communication with the fluid pump, the selection device including at least a first setting and a second setting, the first setting facilitating fluid flow through the at least some apertures at a first pressure, and the second setting facilitating fluid flow through the at least some apertures at a second pressure higher than the first pressure, the selection device including a control circuit configured to delay, for a predetermined amount of time, the increase to the second pressure after the second setting is selected, thereby providing time for the body part to be at least partially submerged in the bath chamber fluid before the increase to the second pressure.

25. The apparatus of claim 24, further comprising a valve in communication with ambient air outside the bath chamber and with the at least some apertures, the valve having a first setting for inhibiting introduction of air into the bath chamber through the at least some apertures, and at least one other setting for effecting introduction of air into the bath chamber through the at least some apertures to generate air bubbles in the fluid contained within the bath chamber.

* * * * *